US005735461A

United States Patent [19]

Winther

[11] Patent Number: 5,735,461

[45] Date of Patent: Apr. 7, 1998

[54] HIGH-PRESSURE CLEANER WITH BYPASS VALVE FOR THE PUMP

[75] Inventor: Lars Winther, Randers, Denmark

[73] Assignee: Kew Industri A/S, Denmark

[21] Appl. No.: 616,203

[22] Filed: Mar. 15, 1996

[30] Foreign Application Priority Data

Mar. 30, 1995 [DK] Denmark ..... 0346/95

[51] Int. Cl.[6] ..... B05B 9/00

[52] U.S. Cl. ..... 239/124; 239/126; 239/526; 239/583; 417/290; 137/115.15

[58] Field of Search ..... 239/124, 126, 239/127, 70, 526, 570, 578, 583; 137/115.15, 115.18; 417/290

[56] References Cited

U.S. PATENT DOCUMENTS

| | | | |
|---|---|---|---|
| 4,182,354 | 1/1980 | Bergstedt | 137/10 |
| 4,197,872 | 4/1980 | Parker | 239/126 |
| 4,589,825 | 5/1986 | Schmidt | 417/290 |
| 5,259,556 | 11/1993 | Paige et al. | 239/124 |
| 5,349,982 | 9/1994 | Goldsmith | 239/124 |
| 5,397,054 | 3/1995 | Ziegs | 239/126 |

FOREIGN PATENT DOCUMENTS

| | | |
|---|---|---|
| 0 407 812 | 6/1990 | European Pat. Off. . |
| 39 36 155 | 10/1989 | Germany . |
| 41 22 527 | 7/1991 | Germany . |
| 93 15 960 | 10/1993 | Germany . |
| 295 00 642 | 1/1995 | Germany . |
| 88 01912 | 9/1986 | WIPO . |

*Primary Examiner*—Andres Kashnikow
*Assistant Examiner*—Lisa Ann Douglas
*Attorney, Agent, or Firm*—Larson & Taylor

[57] ABSTRACT

In a high-pressure cleaner of the type comprising a) a high-pressure pump (3), b) a motor driving said pump (3), c) a liquid supply (1,2) connected to the suction side (8) of the pump (3), d) a cleaning gun (4) connected to the delivery side (6) of the pump (3) through a delivery duct (10) and comprising a manually operable stop valve, and e) a bypass valve (16,17) adapted to in its open condition to allow flow frem the delivery side (6) to the suction side (8) of the pump (3), the main novel feature is f) flow-sensing mechanism (15,20) associated with the delivery duct (10) and adapted to open the bypass valve (16,17) when flow in the delivery duct ceases or decreases below a predetermined magnitude and to act upon it in the closing direction when flow is equal to or above the predetermined magnitude.

With this arrangement, it is possible to utilize the positional change of the bypass valve member (16) for other purposes, such as switching-off the motor (not shown) for the pump (3) by a mechanism means of a normally closed switch (12) operated through a motion-delaying mechanism, such as a spring (35) in combination with a dashpot arrangement (27,36,37,13).

7 Claims, 4 Drawing Sheets

HIGH-PRESSURE CLEANER WITH BYPASS VALVE FOR THE PUMP

TECHNICAL FIELD

The present invention relates to a high-pressure cleaner.

BACKGROUND ART

In high-pressure cleaners of this kind, it is known to use simple check valves, such as a spring-loaded ball valve, as bypass valves intended to open to allow a bypass flow from the delivery side to the suction side of the pump, when the outflow from the delivery side of the pump is blocked, such as by closing the control valve in the cleaning gun. This means, of course, that the bypass valve will not open until the pressure on the delivery side of the pump, hence also in the conduits leading to the cleaning gun, exceeds a predetermined value. At this pressure, the bypass valve will act as a throttling device, and a considerable amount of hydraulic energy will be converted into heat that may eventually lead to overheating of the valve and/or other parts of the high-pressure cleaner. Further, the very high delivery pressure of the pump will remain in the conduits downstream of the pump, thus increasing risks to the operator due to possible leaks or bursts, as well as causing the normally flexible tube to the cleaning gun to be relatively rigid and difficult to handle.

DISCLOSURE OF THE INVENTION

It is the object of the present invention to provide a high-pressure cleaner of the kind referred to above, in which the disadvantages referred to above may be avoided, and this object is achieved with such a cleaner, according to the present invention exhibiting the features set forth in claim 1. With this arrangement, the opening of the bypass valve is initiated by a flow condition rather than a pressure condition, and by using separate flow-sensing means it is possible to cause the bypass valve to open to such an extent, that it does not act as a throttling device. The adoption of the features set forth in claim 2 will ensure that the pressure will fall to a low but finite level, avoiding the risks referred to but still leaving a "residual" pressure, that may be useful when changing from one operating mode to another. Further and due to the extended range of movement of the bypass valve member, it is possible to exploit its movements for operating e.g. a switch breaking the circuit to the pump motor, preferably through a delay arrangement.

Further advantageous embodiments of the high-pressure cleaner according to the invention, the effects of which—beyond what is obvious—are explained in the following detailed portion of the present description.

BRIEF DESCRIPTION OF THE DRAWINGS

In the following detailed portion of the present description, the invention will be explained in more detail with reference to the exemplary embodiment of a high-pressure cleaner according to the invention shown in the drawings, in which.

DESCRIPTION OF THE PREFERRED EMBODIMENT

Figure 1:
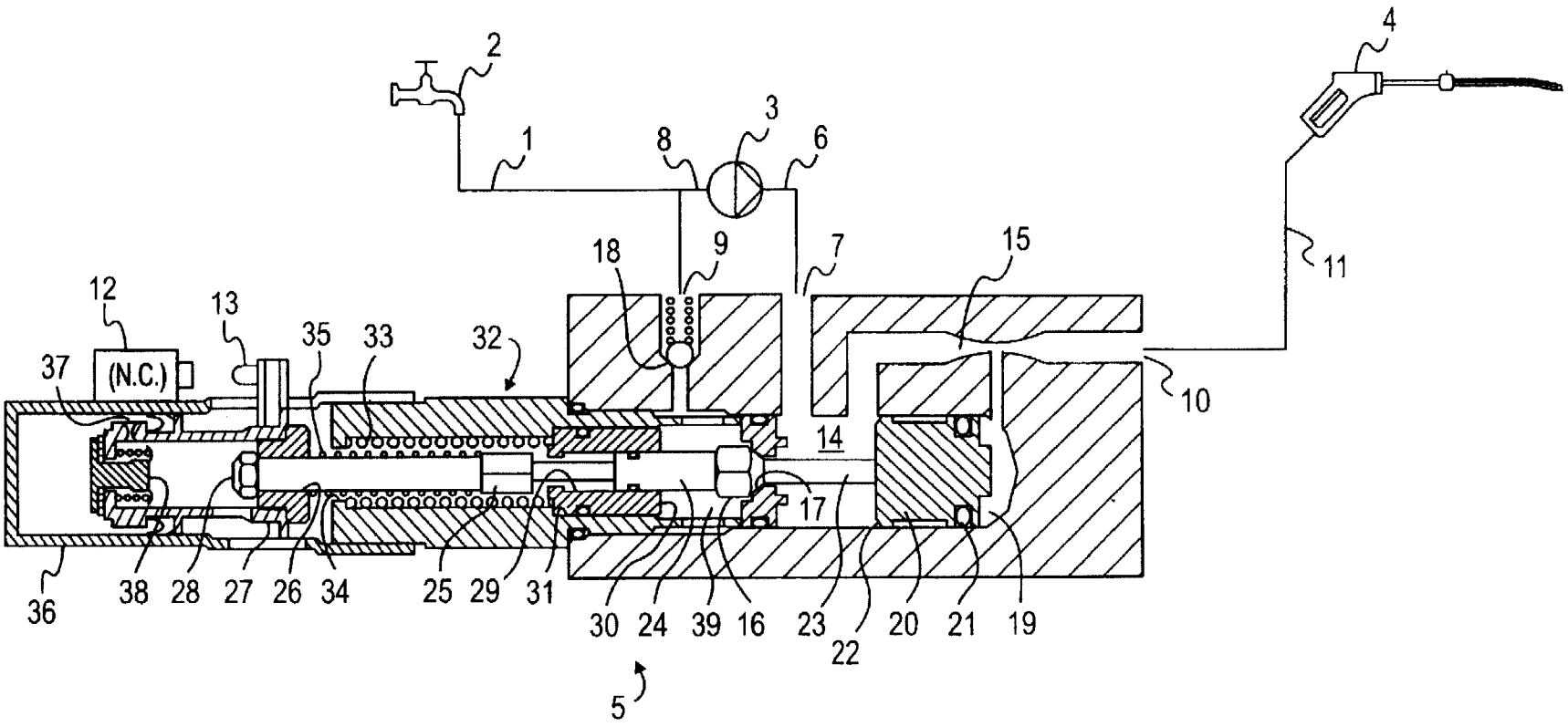
FIG. 1 is a partly diagrammatic overall view showing the essential parts of the high-pressure cleaner.

The high-pressure cleaner, in part shown diagramatically in FIG. 1, comprises the following main components

- a water supply line 1 adapted to be connected to a source of water, such as municipal water mains symbolized by a water cock 2,
- a high-pressure pump 3,
- a drive motor (not shown) for the pump 3,
- a cleaning gun 4, and
- a control unit 5.

The delivery side 6 of the pump 3 is connected to an inlet 7 on the control unit 5, whereas the suction side 8 of the pump 3 is connected, partly to the water supply line 1, partly to a bypass outlet 9 in the control unit 5. An operating outlet 10 on the control unit 5 is connected to the cleaning gun 4, preferably through a flexible tube 11.

The drive motor (not shown) for the high-pressure pump 3 referred to above is connected to its power supply through a normally closed switch 12, so that when the latter is operated by a stop finger 13 as a result of conditions to be described in detail below, the power-supply circuit is interrupted and the motor stops; so will, of course, the pump 3.

The inlet 7 communicates with a pressure chamber 14, the latter communicating partly with the operating outlet 10 through a venturi restriction 15, partly with the bypass outlet 9 through a bypass valve comprising a valve member 16 and a valve seat 17, a bypass space 39, as well as a spring-loaded check valve 18 permitting flow outwardly through the bypass outlet 9.

The pressure chamber 14 is contiguous with a cylinder chamber 19 comprising a piston 20 having a front seal 21 close to the end facing away from the pressure chamber 14, as well as an annular collar 22 at the opposite end.

A control rod 23 is secured at one end to the piston 20, and extends therefrom through the bypass valve seat 17, in this location having the bypass valve member 16 secured to it, further through an increased-diameter part 24, further again through a spring abutment 25 secured to or integral with the control rod 23, finally to end extending slidingly through a bore 26 in a timer piston 27 and terminating in a head 28, the latter in the position shown in FIG. 1 abutting against the part of the timer piston 27 comprising the bore 26.

The increased-diameter part 24 is sealingly and slidingly engaged in a bore 29 in an accumulator piston 30, the latter in turn being sealingly and slidingly engaged in a bore 31 in a stationary part 32 of the control unit 5. An accumulator spring 33 extends between the accumulator piston 30 and a spring abutment 34 on the stationary part 32.

A timer spring 35 extends between the spring abutment 25 on the control rod 23 and the timer piston 27, the latter being sealingly and slidingly engaged in a timer cylinder 36 and cooperating with the latter to form a so-called dashpot arrangement, a restricted orifice 37 on the piston 27 communicating the inside of the timer cylinder 36 with atmosphere. The timer piston 27 also comprises a spring-loaded check valve 38 adapted to open when the piston 27 moves outwardly, i.e. to the right in FIG. 1, in the timer cylinder 36. As mentioned above, the stop finger 13 secured to the timer piston 27 is adapted to cooperate with the normally closed switch 12 under certain conditions to be described in detail below.

The operation of the high-pressure cleaner according to the present invention will now be explained with reference to FIGS. 2–7, these figures showing the control unit 5 in various modes of operation.

Firstly, the operation will be explained for the case, in which the water or other liquid supplied through the supply line 1 is under normal water-mains pressure, i.e. more than 1 bar.

Figure 2:
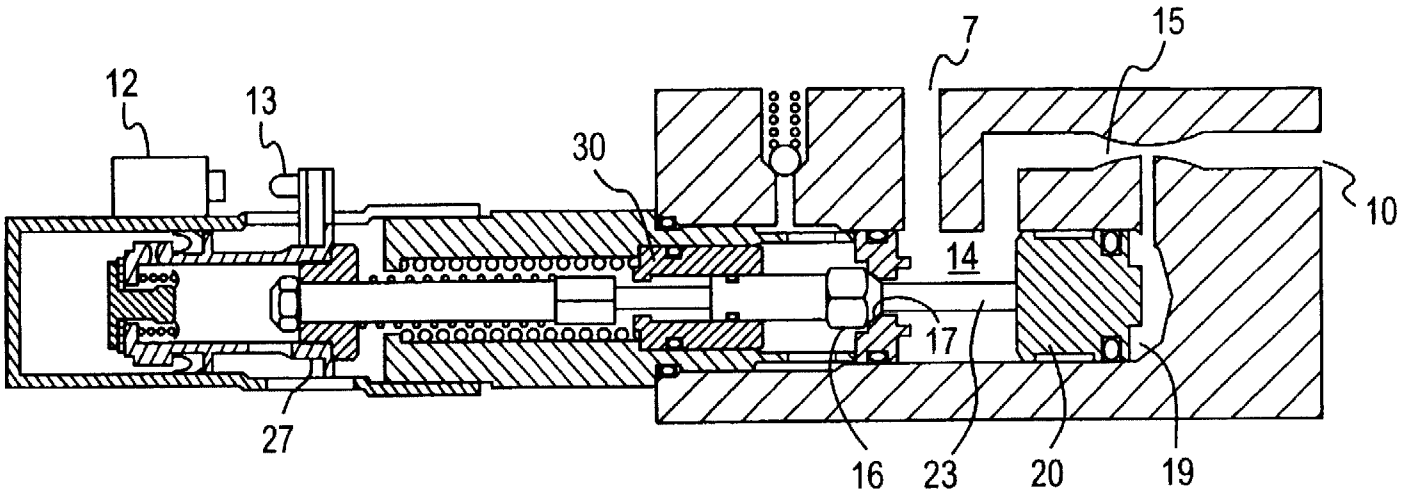
FIGS. 2–6 show the control unit of the high-pressure cleaner shown in FIG. 1 in various operational modes.

FIG. 2 shows the normal cleaning mode, i.e. the mode in which liquid under high pressure is delivered through the operating outlet 10 through the cleaning gun 4. In this mode, the pressure in the inlet 7 is the normal delivery pressure of the pump 3, i.e. approximately 100–200 bars, and this pressure also reigns in the pressure chamber 14. Since liquid is flowing through the venturi restriction 15, a comparatively low pressure reigns in the cylinder chamber 19, thus causing the piston 20 to be held in its extreme right-hand position, in which it—through the control rod 23—keeps the bypass valve member 16 in closing engagement with the bypass valve seat 17.

In the space behind, i.e. to the left of, the valve member 16, a sufficiently high pressure—limited, however, by the check valve 18—has been established during a previous mode to hold the accumulator piston 30 in its extreme left-hand position shown against the force of the accumulator spring 33, the latter thus accumulating a certain amount of positional energy.

Since the piston 20 and with it the control rod 23 is in the extreme right-hand position, the timer piston 27 will also be in its extreme right-hand position, so that the stop finger 13 does not act upon the normally closed switch 12, i.e. power is being supplied to the motor driving the pump 3.

Figure 3:
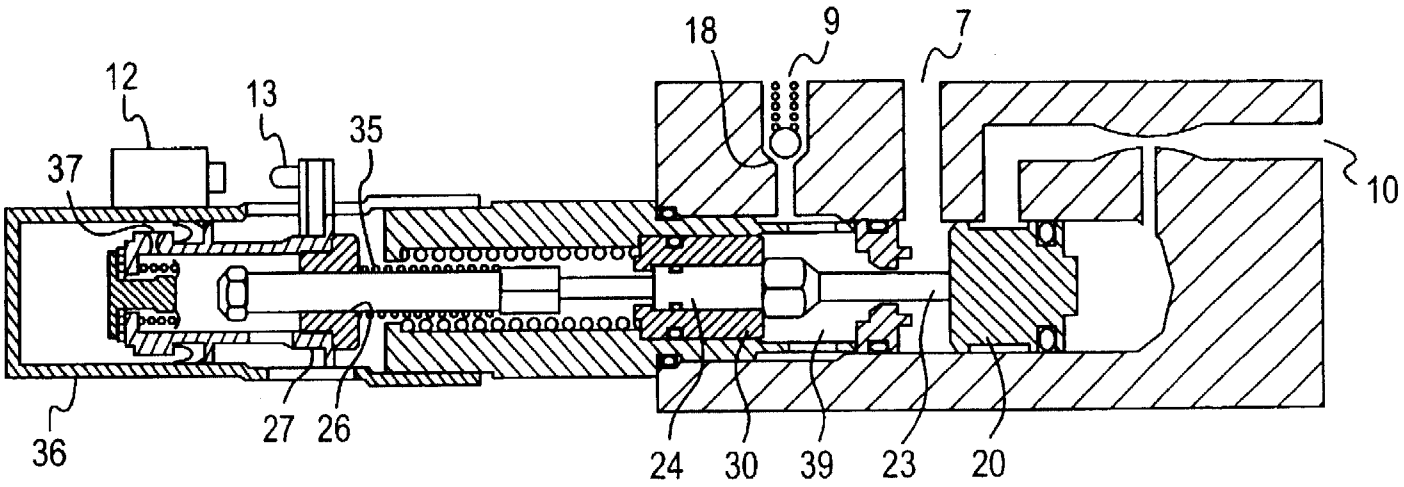

In the bypass mode shown in FIG. 3, flow through the operating outlet 10 has ceased due to the closing of the valve on the cleaning gun 4, but the motor driving the pump 3 is still running, as the switch 12 has not yet been operated. The pressures on both faces of the piston 20 are now substantially equal, and the increased-diameter part 24 will be influenced by the pressure difference between the bypass space 39 and atmosphere so as to move the control rod 23 towards its extreme left-hand position shown in FIG. 3, in which it abuts against the accumulator piston 30. During this movement the control rod 23 advances through the bore 26 in the timer piston 27, thus compressing the timer spring 34. The latter will then push the timer piston 27 towards the left, this movement taking place at a low speed due to the effect of the restricted orifice 37, through which the atmospheric air being compressed in the timer cylinder 36 seeps through to atmosphere.

The bypass valve 16, 17 now being open, a bypass circuit is established from the inlet 7 through the bypass space 39 and the check valve 18 to the bypass outlet 9, thus preventing overloading of the pump 3 and/or its drive motor (not shown). The reduced pressure determined by the check valve 18 now reigns in both the delivery side 6 of the pump 3 and in the tube 11, thus avoiding risks associated with "standing" high pressures. One such risk is that of the tube 11 bursting on contact with a sharp edge or point when the operator is less attentive due to the non-operative state of the cleaning gun 4.

The bypass mode shown in FIG. 3 is in fact a highly temporary mode, as the timer spring 35 will graduately force the timer piston 27 towards the left, ultimately causing the stop finger 13 to operate the normally closed switch 12, thus stopping the motor as well as the pump 3. Since the pump 3 is a displacement pump, e.g. of the axial-cylinder type, the pressure in its delivery side 6 will remain substantially constant in the subsequent stand-by mode shown in FIG. 4. When in this mode normal operation is re-initiated by opening the valve in the cleaning gun 4, the pressure difference between the pressure chamber 14 and the operation outlet 10 will cause liquid to flow—admittedly at a slow rate, because the passage is restricted, but not completely closed, by the collar 22 on the piston 20, the diameter of the collar being slightly less than that of the cylinder 19, thus leaving a narrow gap for restricted flow.

Initially, the piston 20 will be moved through a short distance towards the right, thus disengaging the stop finger 13 from the switch 12, the latter causing the pump 3 to run again and supply further liquid through the inlet 7. As soon as the piston 20 has moved sufficiently towards the right for the collar 22 to open fully the passage between the pressure chamber 14 and the operating outlet 10, the flow in this passage will increase, and the effect of the venturi restriction 15 will lower the pressure in front of the piston 20, so that it moves towards the right, eventually taking up the position corresponding to the normal cleaning mode shown in FIG. 2, in which the bypass circuit is closed by the bypass valve 16, 17. When this valve is still open, however, the pressure in the bypass space 39 will not rise to the same magnitude as that in the pressure chamber 14, but will remain at a reduced value determined by the check valve 18 for a considerable period of time, as the bypass valve 16, 17 and the check valve 18, when closed, will normally be substantially leak-free.

Figure 6:
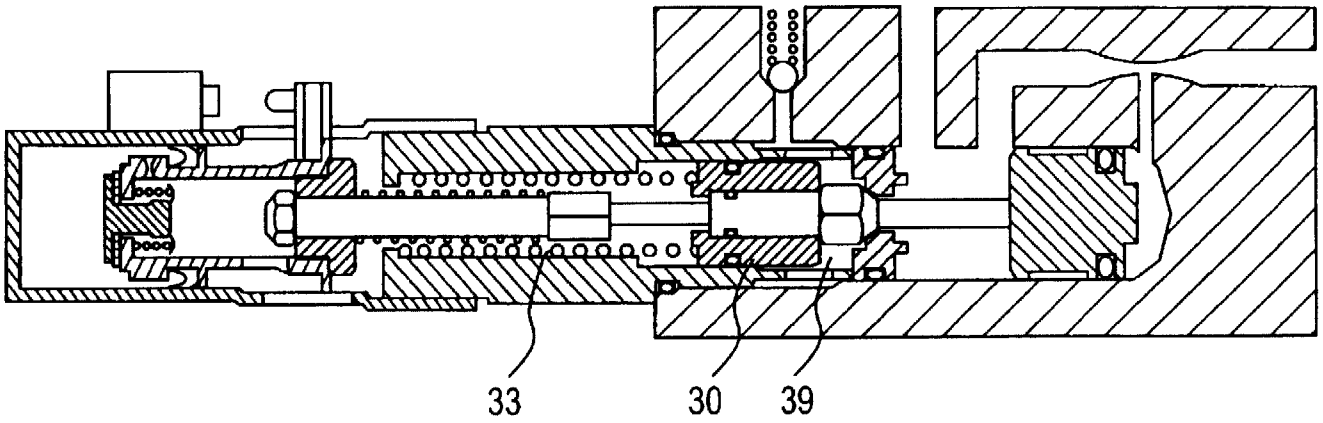
Figure 7:
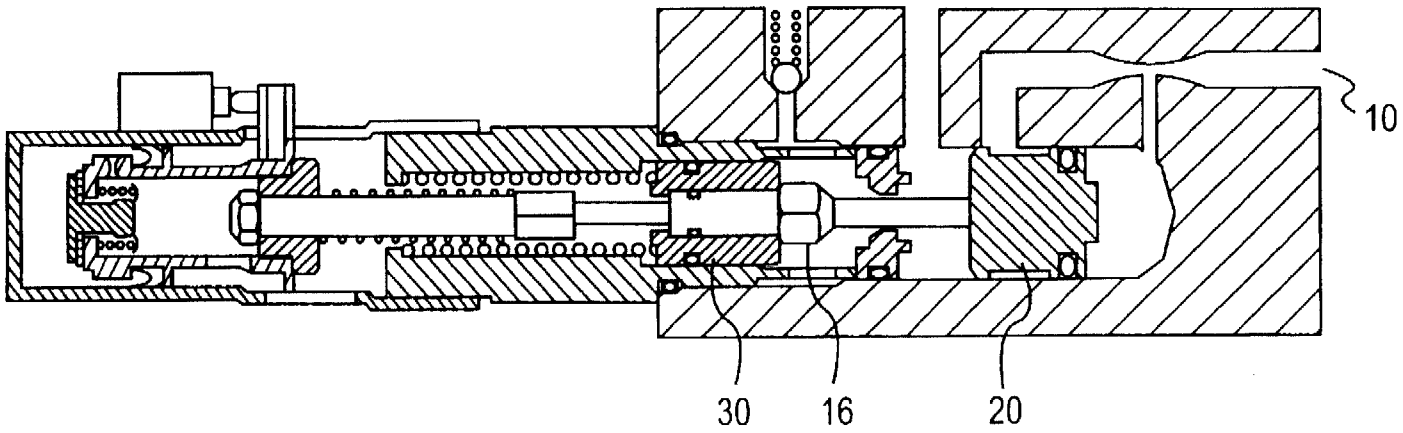

FIG. 6 shows the normal cleaning mode in the case, in which liquid is supplied through the water supply line at a pressure less than 1 bar. Such a situation could possibly occur, if the supply line 1 were immersed in a bucket of water (not shown) instead of being connected to a water cock 2 as shown in FIG. 1. In the operating mode shown in FIG. 6, all the moveable parts take up the same positions as shown in FIG. 2 with the exception of the accumulator piston 30, the "residual" pressure in the bypass space 39 not being sufficient to force the accumulator piston 30 towards the left against the force of the accumulator spring 33. Apart from this difference, the device operates exactly in the same manner as explained with reference to FIG. 2.

When the operating mode shown in FIG. 6 is terminated by closing the valve in the cleaning gun 4, the various events take place excactly as described with reference to the transition between the mode shown in FIG. 2 and that shown in FIG. 3, with the exception that the accumulator piston 30 will now be forced towards the left against the force of the accumulator spring 33 to the position shown in FIG. 3 illustrating the bypass mode.

Figure 4:
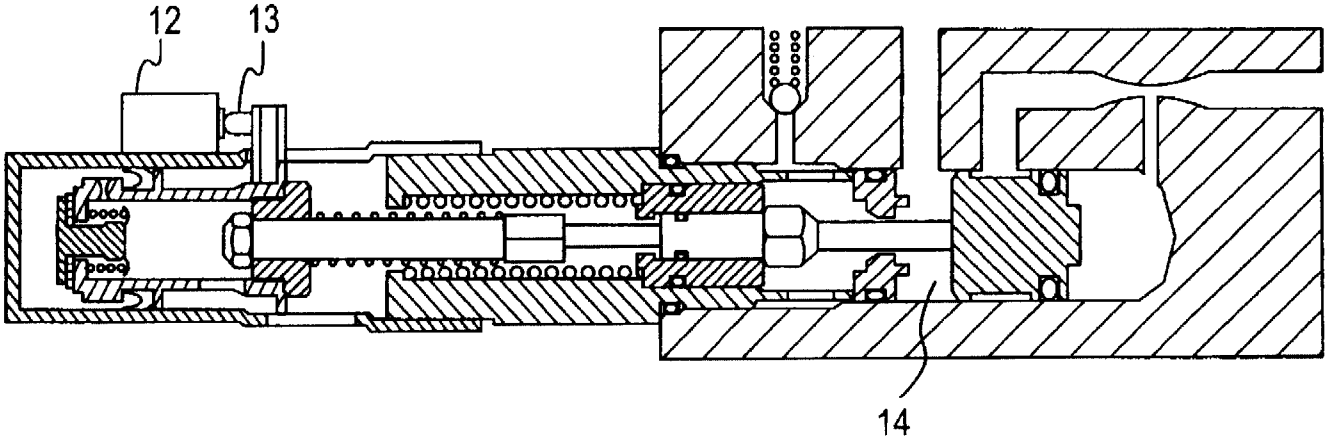
Figure 5:
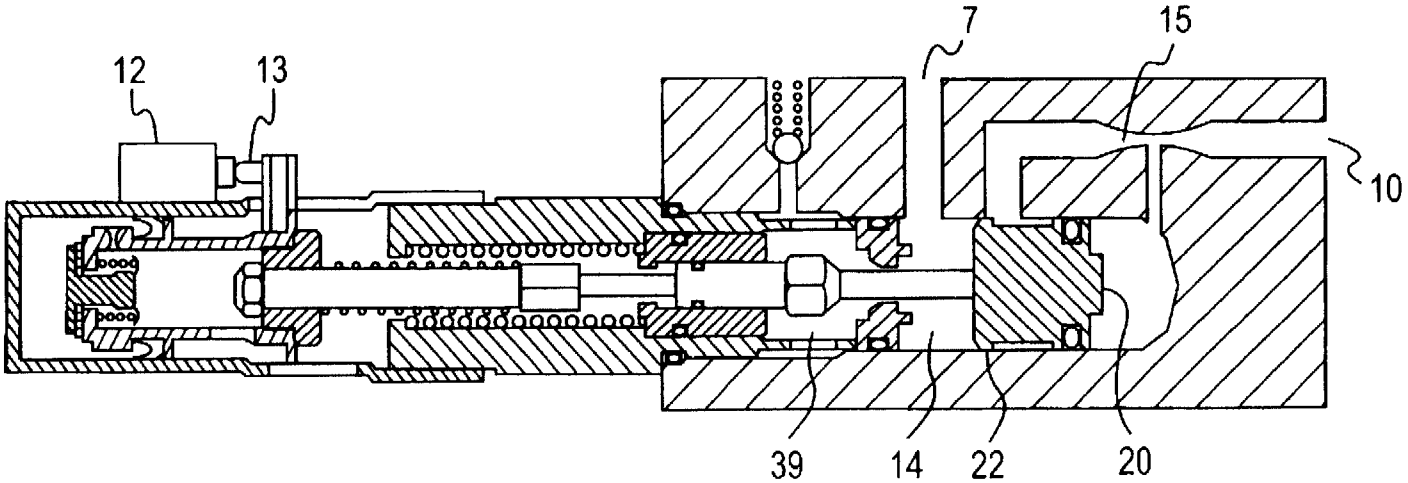

As mentioned above, the bypass mode shown in FIG. 3 is a transitory one, and will change into the stand-by mode shown in FIG. 4 when the timer piston has completed its stroke to make the stop finger 13 operate the normally closed switch 12 and stop the motor for the pump 3.

When, as in this case, operating with reduced pressure in the inlet 7, the "residual" pressure in the bypass space 39 will be somewhat lower than in the case with water-mains supply, since this "residual" pressure is substantially equal to the pressure in the supply line 1 plus the opening pressure of the check valve 18. For this reason, the accumulator piston 30 will take up an intermediate position shown in FIG. 7 and subsequently, when the flow through the operating outlet 10 is re-initiated by the valve in the cleaning gun 4 being opened, it will engage the valve member 16, thus assisting the hydraulic force tending to move the piston 20 towards the right so as to re-establish the normal cleaning mode as shown in FIG. 6.

LIST OF PARTS

1 water supply line
2 water cock
3 high-pressure pump
4 cleaning gun
5 control unit
6 delivery side
7 inlet
8 suction side 9 bypass outlet
10 operating outlet
11 flexible tube
12 normally closed switch
13 stop finger
14 pressure chamber
15 venturi restriction
16 bypass valve member
17 bypass valve seat
18 check valve
19 cylinder chamber
20 piston
21 front seal
22 collar
23 control rod
24 increased-diameter part
25 spring abutment
26 bore
27 timer piston
28 head
29 bore
30 accumulator piston
31 bore
32 stationary part
33 accumulator spring
34 spring abutment
35 timer spring
36 timer cylinder
37 restricted orifice
38 check valve
39 bypass space

I claim:

1. A high pressure cleaner comprising:

a high-pressure pump having a suction side and a delivery side;

a motor driving said pump and having a power-supply circuit;

a liquid supply connected to the suction side of said pump;

a cleaning gun connected to the delivery side of said pump through a delivery duct and comprising a manually operable stop valve;

a bypass valve for, in an open condition, allowing flow from said delivery side to said suction side of said pump;

flow-sensing means, associated with said delivery duct, for opening said bypass valve when flow in said delivery duct ceases or decreases below a predetermined magnitude and for acting upon said bypass valve in a direction providing closing of said valve when said flow is equal to or above said predetermined magnitude, a normally closed switch connected in the power-supply circuit for said motor and mechanically connected to said flow-sensing means, and movement-delaying means, mechanically connected to said flow-sensing means and to said switch, for, when said flow-sensing means opens said bypass valve, providing opening of said switch after a predetermined time interval.

2. High-pressure cleaner according to claim 1, further comprising a non-return valve connected between said bypass valve and said suction side and adapted to allow flow from the former to the latter when subjected to a predetermined pressure difference.

3. High-pressure cleaner according to claim 2, further comprising a pressure-sensitive means, subjected to the pressure in a duct interconnecting said bypass valve and said non-return valve, for closing the bypass valve, when said pressure decreases to or below a predetermined magnitude.

4. High-pressure cleaner according to claim 1, wherein said flow-sensing means comprises a venturi restriction in said delivery duct downstream of said delivery side and upstream of said cleaning gun, and an actuating cylinder in communication with said venturi restriction and having sealingly slidable therein a first piston, and wherein a movable part of said bypass valve is connected to said first piston.

5. High-pressure cleaner according to claim 4 wherein said first piston includes, on an end facing away from a closed end of said actuating cylinder, a radially outwardly protruding collar for closing incompletely the passage between the delivery side of said pump and said delivery duct when in a position keeping said bypass valve open, so as to leave a small flow passage acting as a restriction.

6. High-pressure cleaner according to claim 4, wherein said actuating rod is connected to a switch-operating member through a spring, said switch-operating member being connected to a unidirectional dashpot member, and the latter, together with said spring, constituting said movement-delaying means.

7. High-pressure cleaner according to claim 6, wherein said pressure sensitive means comprises a second piston slidable in a cylinder communicating with or constituting part of said duct interconnecting said bypass valve and said non-return valve, said second piston being adapted to cooperate with a spring and with the moveable part of said bypass valve in such a manner that, when the pressure in said duct increases above a predetermined magnitude, said second piston is acted upon said pressure to compress said spring, and when said pressure decreases to or below said magnitude, said opening moves or holds said piston in abutment with said moveable part so as to close or contribute to the closing of said bypass valve.

* * * * *